US011427999B2

(12) United States Patent
Perdue

(10) Patent No.: US 11,427,999 B2
(45) Date of Patent: Aug. 30, 2022

(54) ACOUSTIC ISOLATION BOOTH

(71) Applicant: JayVic LLC, Amarillo, TX (US)

(72) Inventor: Joab Perdue, Amarillo, TX (US)

( * ) Notice: Subject to any disclaimer, the term of this patent is extended or adjusted under 35 U.S.C. 154(b) by 0 days.

(21) Appl. No.: 17/180,628

(22) Filed: Feb. 19, 2021

(65) Prior Publication Data

US 2021/0254330 A1 Aug. 19, 2021

Related U.S. Application Data

(60) Provisional application No. 62/978,366, filed on Feb. 19, 2020.

(51) Int. Cl.

| | |
|---|---|
| ***F41J 11/00*** | (2009.01) |
| ***E04B 1/82*** | (2006.01) |
| ***E04B 1/32*** | (2006.01) |
| ***G10K 11/162*** | (2006.01) |
| ***E04C 2/24*** | (2006.01) |
| ***E04H 1/12*** | (2006.01) |
| ***E04B 1/86*** | (2006.01) |

(52) U.S. Cl.

CPC ..... *E04B 1/8218* (2013.01); *E04B 1/3205* (2013.01); *E04B 1/86* (2013.01); *E04C 2/243* (2013.01); *E04H 1/125* (2013.01); *G10K 11/162* (2013.01)

(58) Field of Classification Search

CPC ..... E04B 1/32; E04B 1/3205; E04B 1/8218; E04B 1/86; E04B 7/10; E04C 2/243; E04H 1/125; F41J 11/00; G10K 11/162

USPC ..... 52/86

See application file for complete search history.

(56) References Cited

U.S. PATENT DOCUMENTS

| | | | | |
|---|---|---|---|---|
| 3,382,821 | A * | 5/1968 | Dundr | F41J 11/00 109/82 |
| 4,247,115 | A * | 1/1981 | Nikoden, Jr. | F41J 11/00 108/48 |
| 10,048,046 | B1 * | 8/2018 | Iliev | B32B 9/007 |
| 10,845,168 | B1 * | 11/2020 | Rushing | E04C 2/523 |
| 2017/0292818 | A1 * | 10/2017 | Atluri | F41J 9/02 |
| 2020/0256653 | A1 * | 8/2020 | Rushing | F41J 11/02 |
| 2021/0131096 | A1 * | 5/2021 | Mordechai | E04B 1/6158 |

* cited by examiner

*Primary Examiner* — Brent W Herring
*Assistant Examiner* — James J Buckle, Jr.
(74) *Attorney, Agent, or Firm* — Shannon Warren

(57) ABSTRACT

An acoustic isolation booth for providing a space for noise-making out of earshot from other parties. wherein: the acoustic isolation booth comprises a shell comprising at least two compartments, an intermediate wall, a plurality of outer walls, a ceiling and one or more entryways. The shell comprises a shell width, a shell depth and a shell height. The two compartments comprise at least a first compartment and a second compartment. each of the two compartments comprises a compartment depth, a compartment width and a compartment height. A first side wall, the intermediate wall and a second side wall are configured to divide a space within the shell into the first compartment and the second compartment.

12 Claims, 13 Drawing Sheets

ACOUSTIC ISOLATION BOOTH

CROSS-REFERENCE TO RELATED APPLICATIONS

This application claims benefit to U.S. Patent Application No. 62/978,366 filed 2020 Feb. 19.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

No prior art is known to the Applicant

BRIEF SUMMARY OF THE INVENTION

An acoustic isolation booth for providing a space for noisemaking out of earshot from other parties. wherein: said acoustic isolation booth comprises a shell comprising at least two compartments, an intermediate wall, a plurality of outer walls, a ceiling and one or more entryways. Said shell comprises a shell width, a shell depth and a shell height. Said two compartments comprise at least a first compartment and a second compartment. each of said two compartments comprises a compartment depth, a compartment width and a compartment height. A first side wall, said intermediate wall and a second side wall are configured to divide a space within said shell into said first compartment and said second compartment. Said plurality of outer walls and said intermediate wall comprises a thickness. Said intermediate wall comprises an intermediate wall height. portions of said shell is constructed of a composition. such as, said intermediate wall, said ceiling, said first side wall, said second side wall and sometimes, a shelf. Said composition comprises an insulation, two retaining boards. Said two retaining boards comprises a first board and a second board. Said two retaining boards comprises Masonite. Said insulation comprises Rockwool.

Said acoustic isolation booth for providing a space for noisemaking out of earshot from other parties. wherein: said acoustic isolation booth comprises said shell comprising at least said two compartments, said intermediate wall, said plurality of outer walls, said ceiling and said one or more entryways. Said shell comprises said shell width, said shell depth and said shell height. Said two compartments comprise at least said first compartment and said second compartment. each of said two compartments comprises said compartment depth, said compartment width and said compartment height. Said first side wall, said intermediate wall and said second side wall are configured to divide a space within said shell into said first compartment and said second compartment. Said plurality of outer walls and said intermediate wall comprises said thickness. Said intermediate wall comprises said intermediate wall height.

Said acoustic isolation booth for providing a space for noisemaking out of earshot from other parties. wherein: said acoustic isolation booth comprises said shell comprising at least said two compartments, said intermediate wall, said plurality of outer walls, said ceiling and said one or more entryways. Said shell comprises said shell width, said shell depth and said shell height. Said two compartments comprise at least said first compartment and said second compartment. each of said two compartments comprises said compartment depth, said compartment width and said compartment height. Said first side wall, said intermediate wall and said second side wall are configured to divide a space within said shell into said first compartment and said second compartment. Said plurality of outer walls and said intermediate wall comprises said thickness. Said intermediate wall comprises said intermediate wall height. Said acoustic isolation booth further comprises one or more speakers. Said one or more speakers is configured to play an interference track comprising an audio signal emanating from said one or more speakers. Said interference track comprises a sibilance loop of sounds such as "ch", "ss", "ttt", and similar. Said interference track is configured to interfere with parties listening in on sounds made inside of said two compartments. Said acoustic isolation booth comprises said ceiling having an arched roof and an upper internal arched surface. Said intermediate wall comprises said intermediate wall height, said acoustic isolation booth comprises said shell height, said two compartments comprises a first height and a second height, and a sound gap comprises a sound gap height. Said acoustic isolation booth is further comprises said sound gap between said two compartments and below said ceiling. Said sound gap configured to allow sound otherwise blocked by said intermediate wall to pass between said two compartments.

DETAILED DESCRIPTION OF THE INVENTION

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
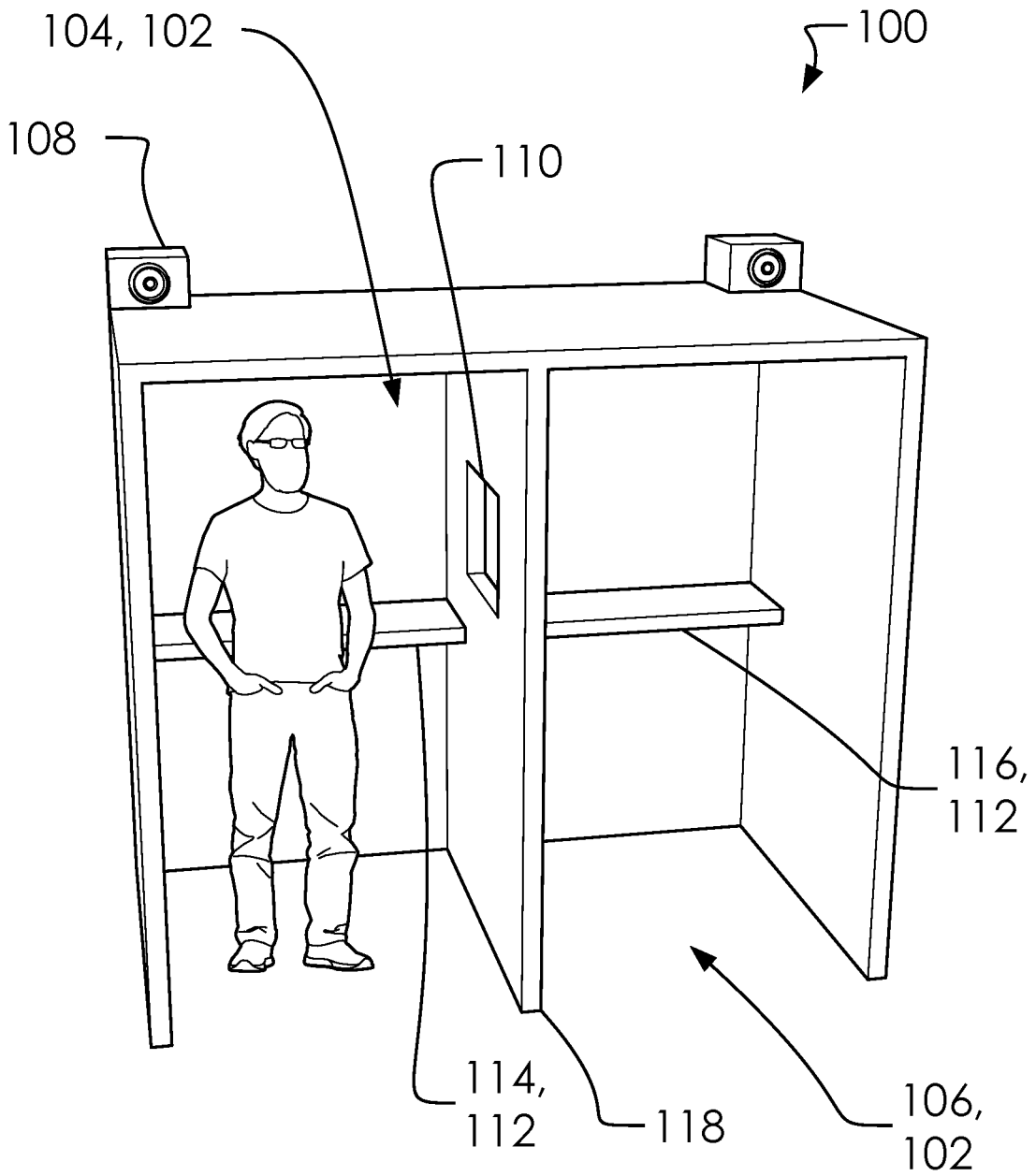
FIG. 1 illustrates a perspective overview of an acoustic isolation booth 100.

FIG. 1 illustrates a perspective overview of an acoustic isolation booth 100.

In one embodiment, said acoustic isolation booth 100 can comprise two compartments 102 (which can comprise a first compartment 104 and a second compartment 106), one or more speakers 108, and an intermediate wall opening 110 in an intermediate wall 118.

Each among said two compartments 102 can comprise a shelf 112. For example, said first compartment 104 can comprise a first shelf 114 and said second compartment 106 can comprise a second shelf 116.

Figure 2:
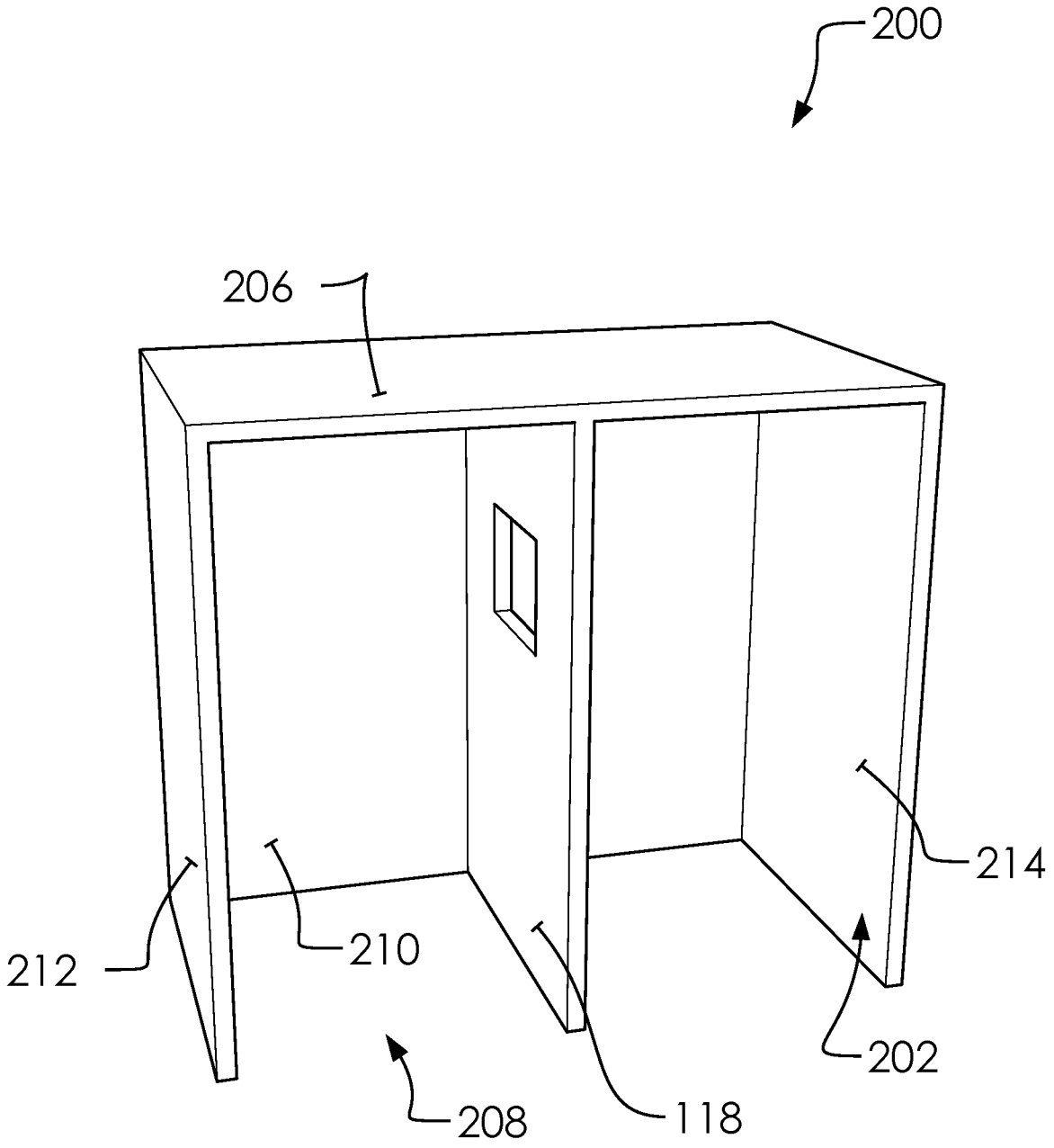
FIG. 2 illustrates a perspective overview of a shell 200 of said acoustic isolation booth 100.

FIG. 2 illustrates a perspective overview of a shell 200 of said acoustic isolation booth 100.

In one embodiment, said acoustic isolation booth 100 can comprise said shell 200. Said shell 200 can comprise a plurality of outer walls 202, a ceiling 206, and one or more entryways 208. Said plurality of outer walls 202 can comprise a rear wall 210, a first side wall 212, and a second side wall 214.

As illustrated, said shell 200 can comprise a rectangular shape and said plurality of outer walls 202 can comprise rectangular planar walls. Said ceiling 206 can cover the entirety of a volume defined by said two compartments 102. Further, said first side wall 212, said intermediate wall 118 and said second side wall 214 can divide a space within said shell 200 into said first compartment 104 and said second compartment 106.

Figure 3A:
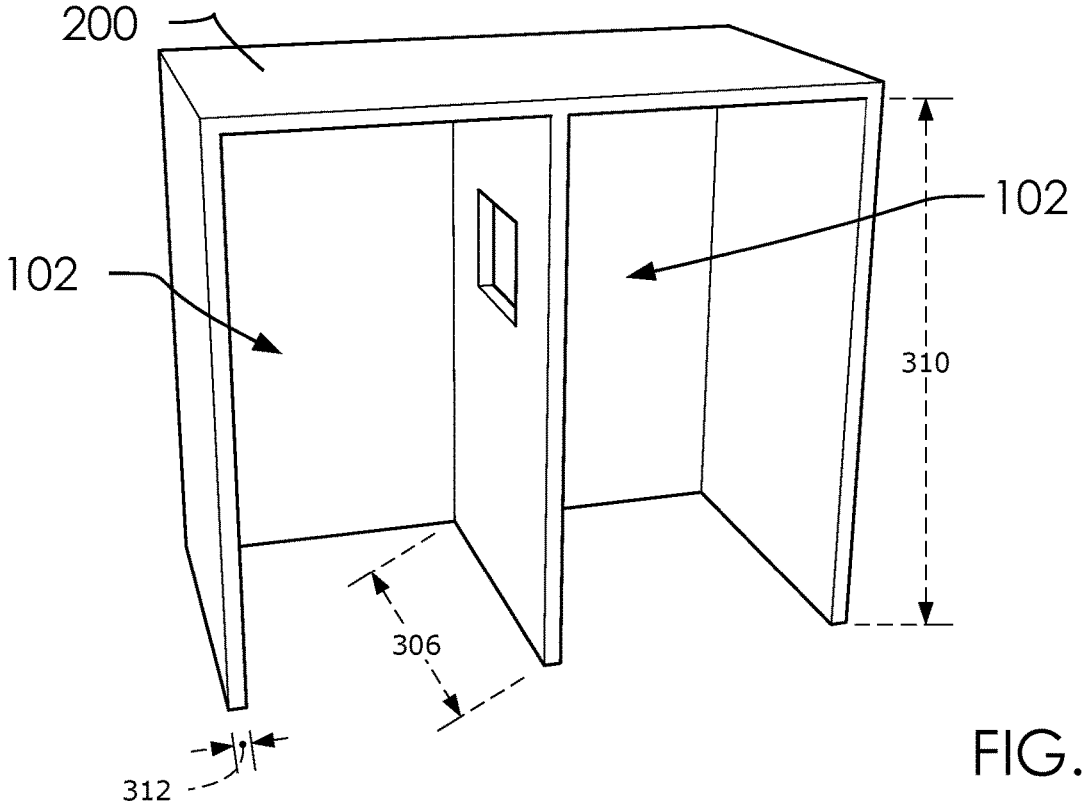
FIGS. 3A, 3B and 3C illustrate a perspective overview, elevated side view and elevated front view of said shell 200.
Figure 3B:
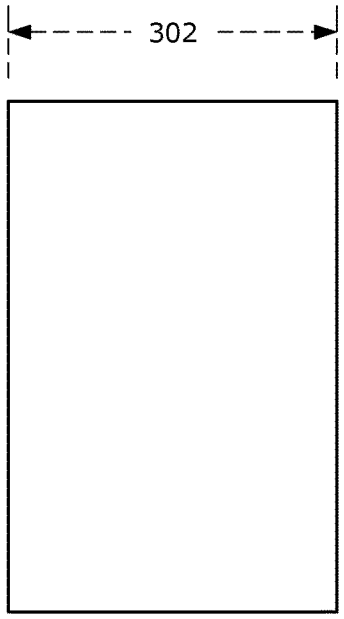
Figure 3C:
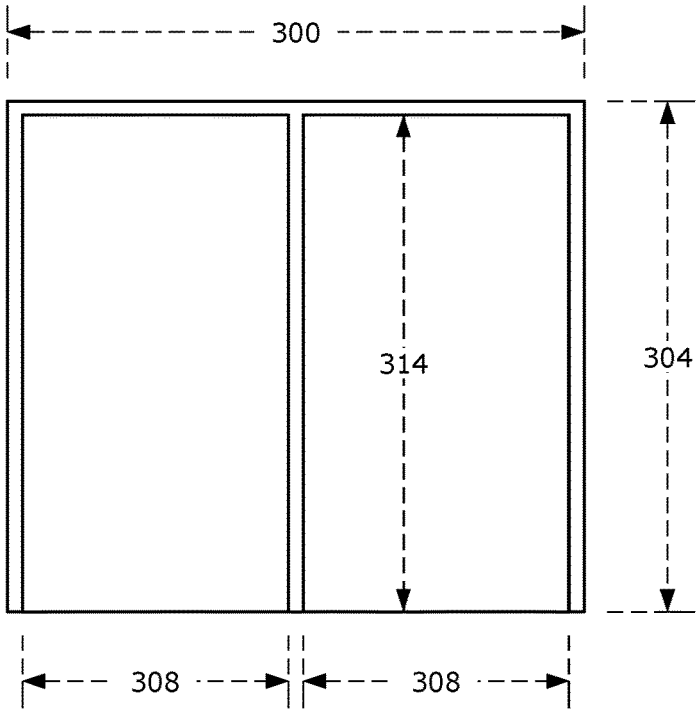

FIGS. 3A, 3B and 3C illustrate a perspective overview, elevated side view and elevated front view of said shell 200.

In one embodiment, said shell 200 can comprise a shell width 300, a shell depth 302, and a shell height 304. Said two compartments 102 can each comprise a compartment depth 306, a compartment width 308, and a compartment height 310. Said plurality of outer walls 202 and said intermediate wall 118 can comprise a thickness 312. Said intermediate wall 118 can comprise an intermediate wall height 314.

Figure 4:
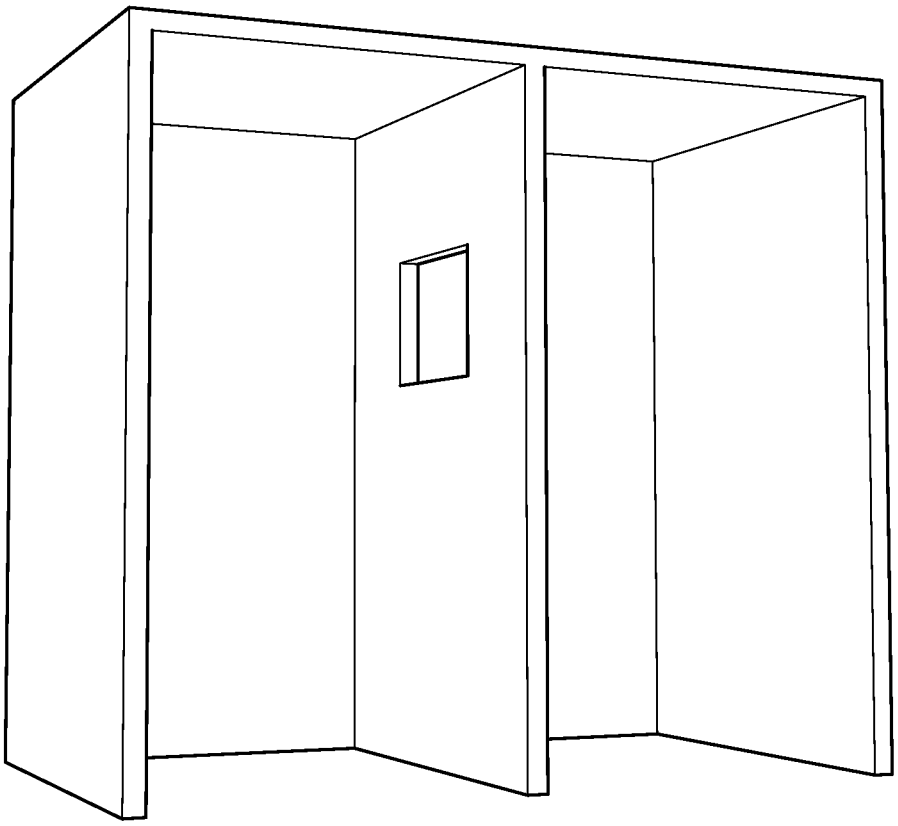
FIG. 4 illustrates a perspective lower view of said shell 200.

FIG. 4 illustrates a perspective lower view of said shell 200.

Figure 5A:
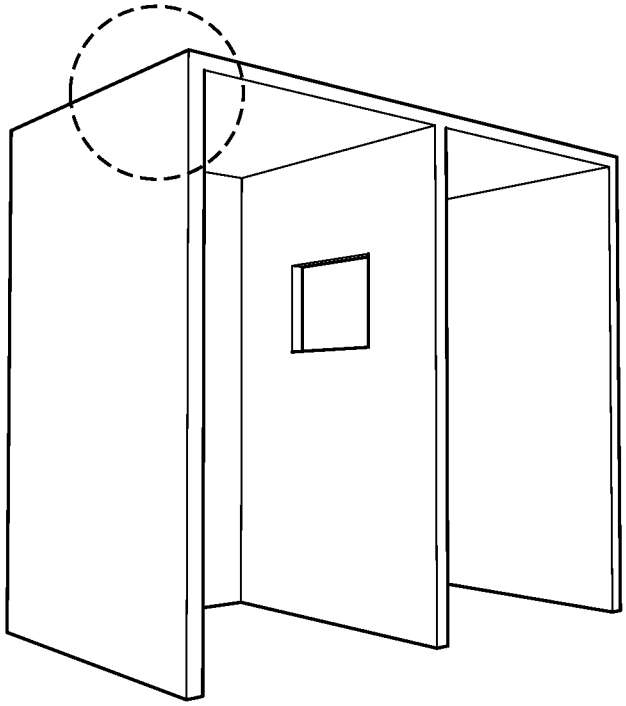
FIGS. 5A and 5B illustrate a perspective overview and detailed view of said shell 200 and a plurality of outer walls 202, respectively.
Figure 5B:
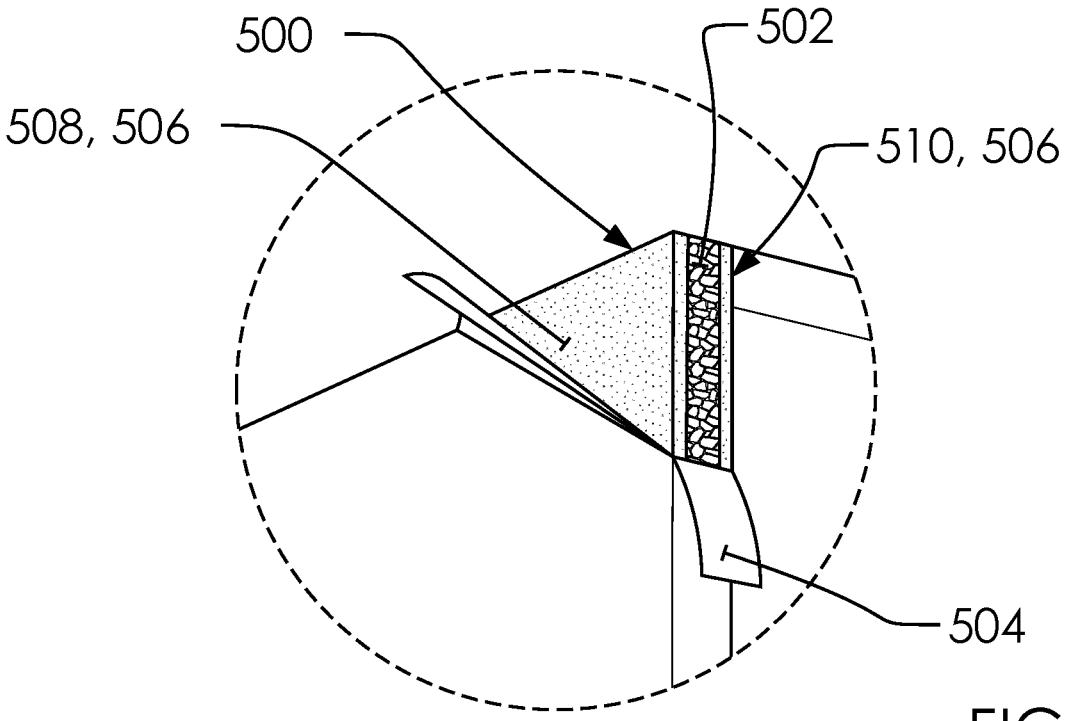

FIGS. 5A and 5B illustrate a perspective overview and detailed view of said shell 200 and said plurality of outer walls 202, respectively.

As illustrated, a shell cover 504 is peeled back to reveal a composition 500 of said shell 200, In one embodiment, portions of said shell 200 can be constructed of said composition 500; such as, said intermediate wall 118, said ceiling 206, said first side wall 212, said second side wall 214 and sometimes, said shelf 112.

In one embodiment, said composition 500 can comprise an insulation 502, two retaining boards 506. Said two retaining boards 506 can comprise a first board 508 and a second board 510. In one embodiment, said two retaining boards 506 can comprise Masonite, and said insulation 502 can comprise Rockwool.

Figure 6:
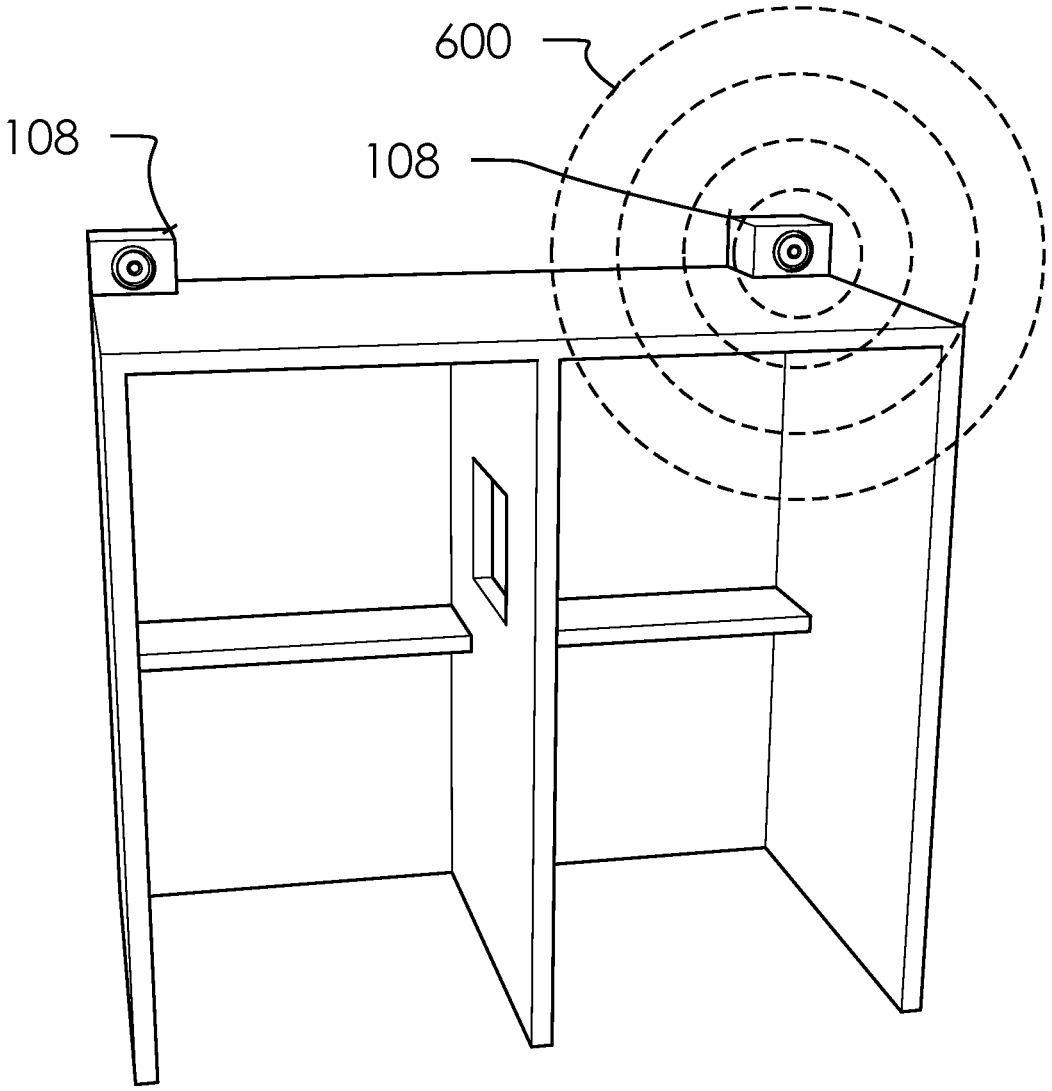
FIG. 6 illustrates a perspective overview of said acoustic isolation booth 100.

FIG. 6 illustrates a perspective overview of said acoustic isolation booth 100.

Said acoustic isolation booth 100 can comprise said one or more speakers 108.

In one embodiment, said one or more speakers 108 can play an interference track 600. In one embodiment, said interference track 600 can comprise a sibilance loop of sounds such as "ch", "ss", "ttt", and similar. Accordingly, said interference track 600 can interfere with parties listening in on sounds made inside of said two compartments 102. In one embodiment, said interference track 600 can comprise 60 dB of sound, enough to mask noises made in said acoustic isolation booth 100.

One goal of said acoustic isolation booth 100 is to allow medical professionals to speak with one another through said intermediate wall opening 110, or speak into a recording device while facing a portion of said shell 200, such as said rear wall 210.

Figure 7:
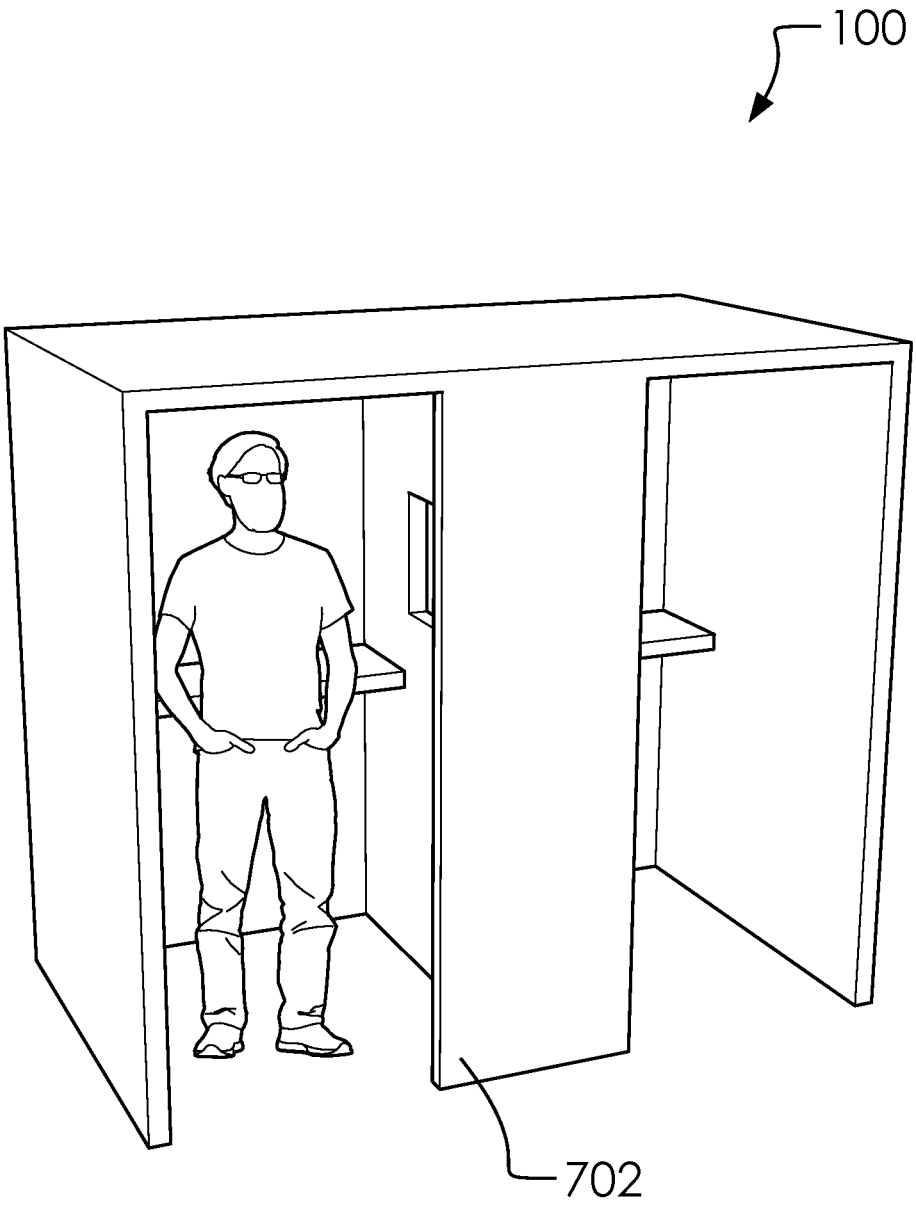
FIG. 7 illustrates a perspective overview of said acoustic isolation booth 100 with a front enclosure 702.

FIG. 7 illustrates a perspective overview of said acoustic isolation booth 100 with a front enclosure 702.

Figure 8A:
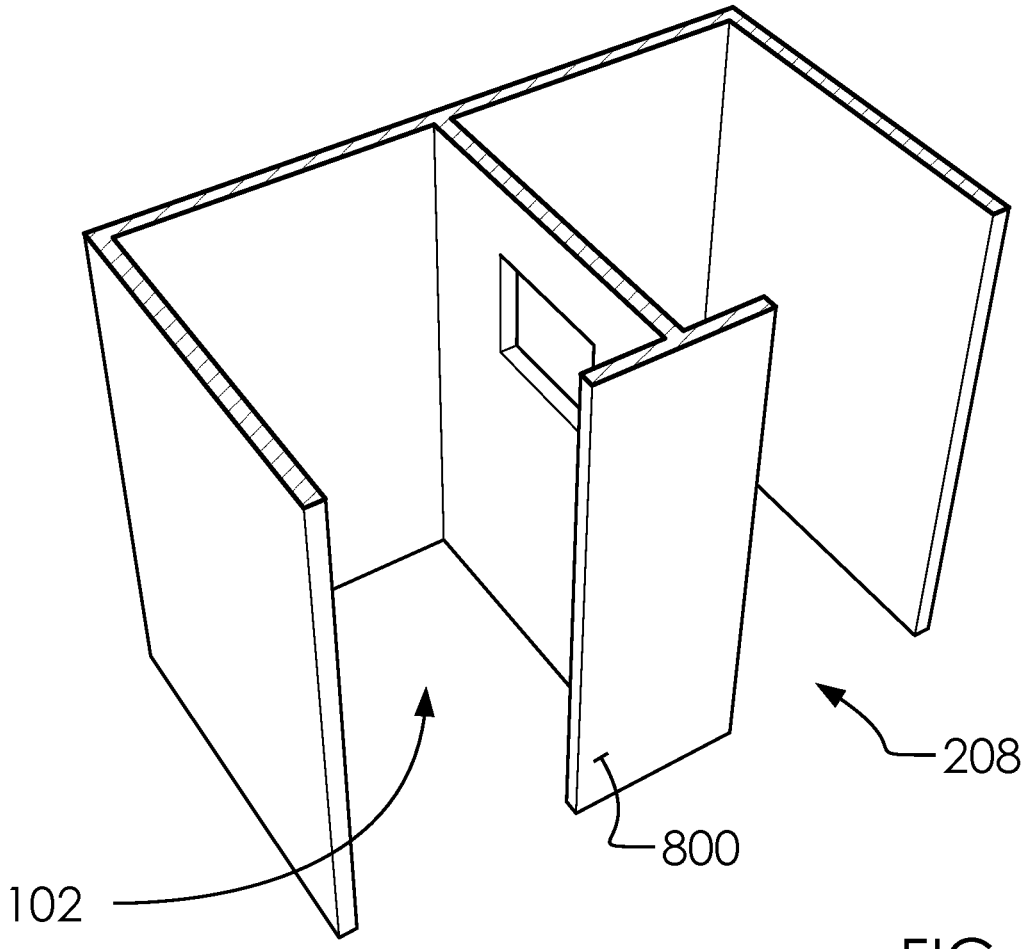
FIGS. 8A and 8B illustrate a perspective overview of said acoustic isolation booth 100 with said front enclosure 702 in cross-section.
Figure 8B:
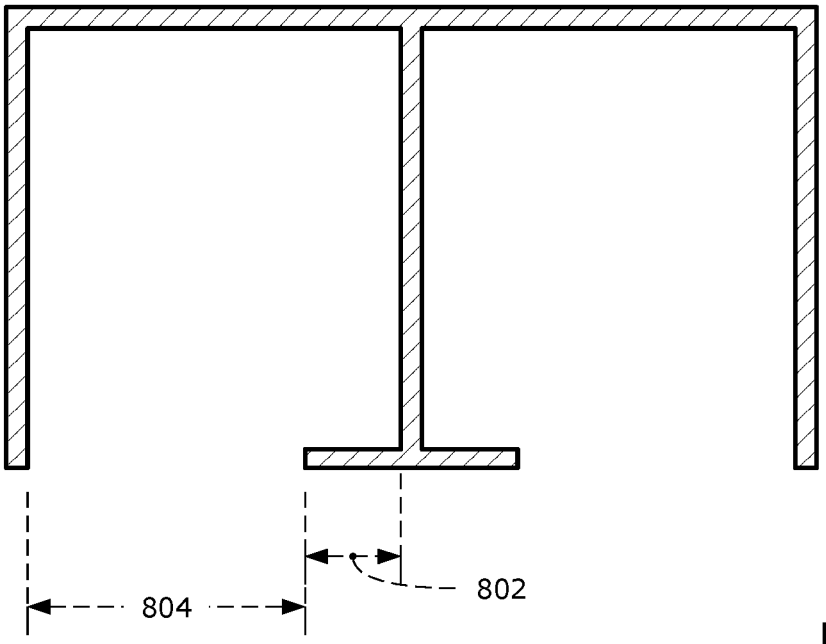

FIGS. 8A and 8B illustrate a perspective overview of said acoustic isolation booth 100 with said front enclosure 702 in cross-section.

In one embodiment, each of said two compartments 102 can comprise a front enclosure portion 800 of said front enclosure 702 encompassing a portion of said one or more entryways 208. Said front enclosure portion 800 can comprise a front enclosure width 802; wherein, said front enclosure width 802 plus a modified opening width 804 can equal said compartment width 308.

In one embodiment, said front enclosure width 802 can be wider to more fully enclose said two compartments 102.

Figure 9:
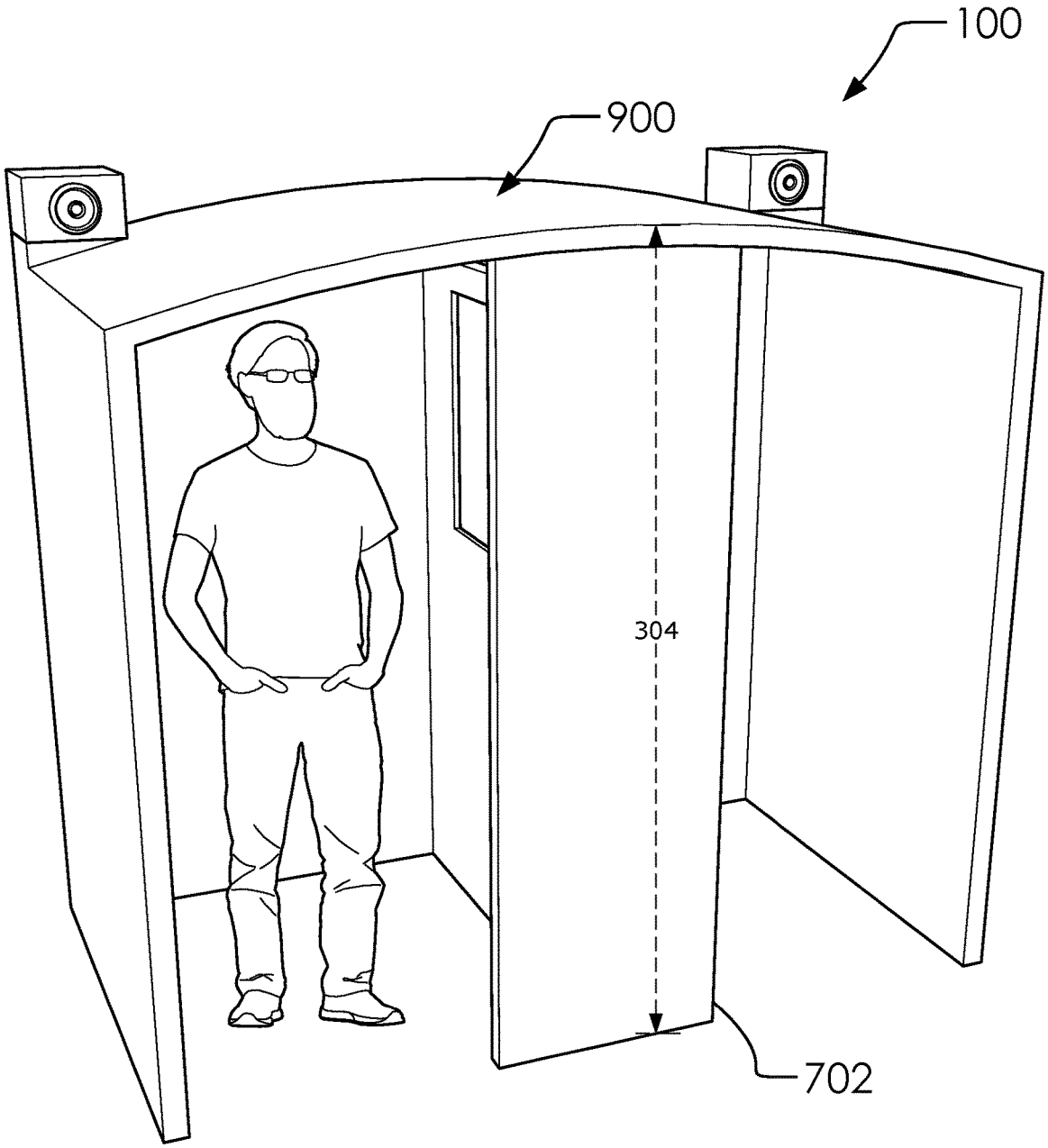
FIG. 9 illustrates a perspective overview of said acoustic isolation booth 100 with an arched roof 900.

FIG. 9 illustrates a perspective overview of said acoustic isolation booth 100 with an arched roof 900.

In one embodiment, said acoustic isolation booth 100 can comprise said ceiling 206 having an arched shape, as shown with said arched roof 900.

Figure 10:
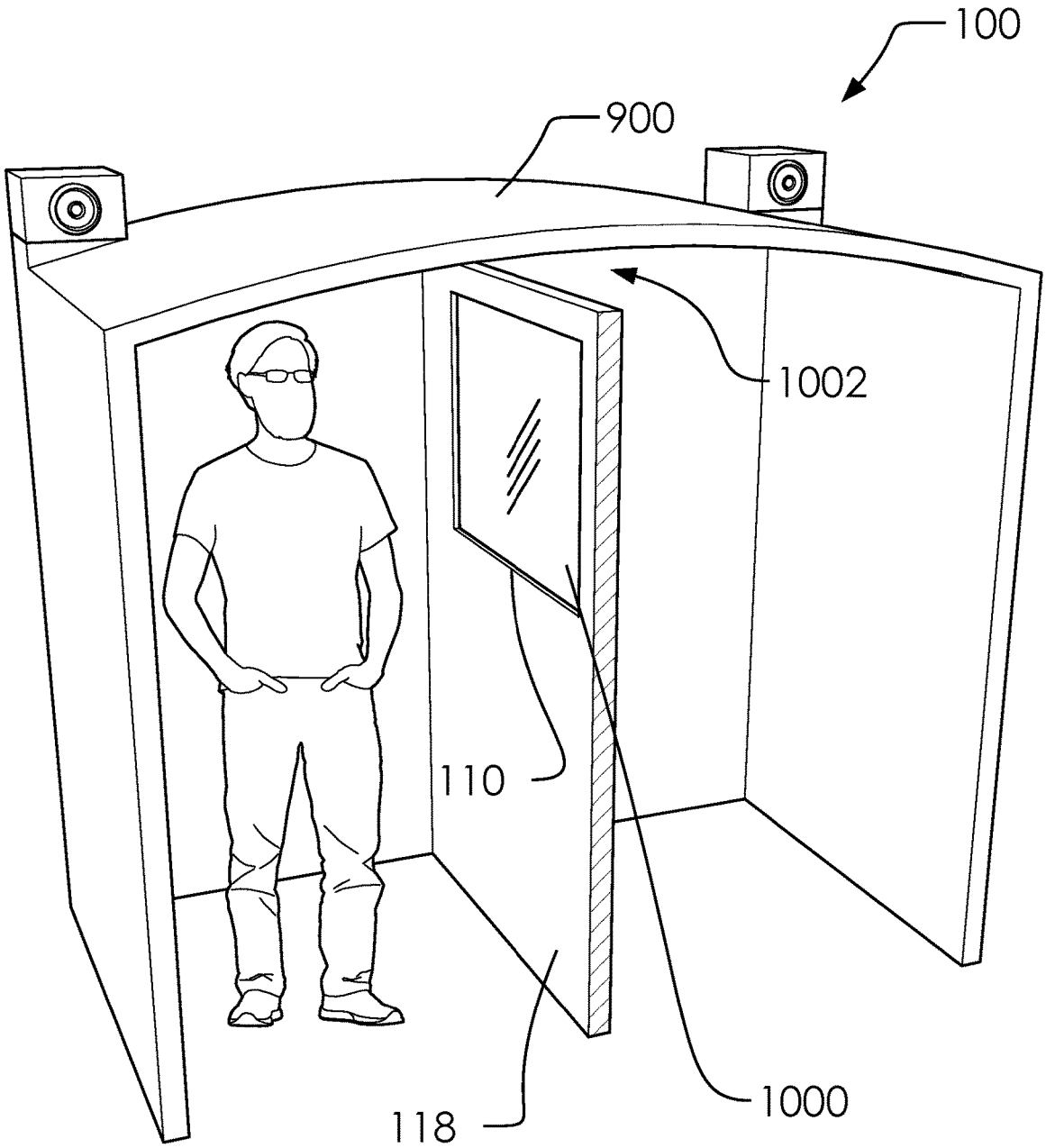
FIG. 10 illustrates a perspective overview of said acoustic isolation booth 100 with said front enclosure 702 removed and a ceiling 206 comprising said arched roof 900.

FIG. 10 illustrates a perspective overview of said acoustic isolation booth 100 with said front enclosure 702 removed and said ceiling 206 comprising said arched roof 900.

In one embodiment, said intermediate wall 118 can comprise an intermediate chamber window 1000. In one embodiment, said intermediate chamber window 1000 can fill said intermediate wall opening 110 to as to prevent movement of germs between said two compartments 102. However, because said intermediate chamber window 1000 will effectively prevent sound from moving between ing between said two compartments 102, a new means of communication needs to be provided. Therefore, in one embodiment, a sound gap 1002 between said two compartments 102 and below said arched roof 900.

Figure 11:
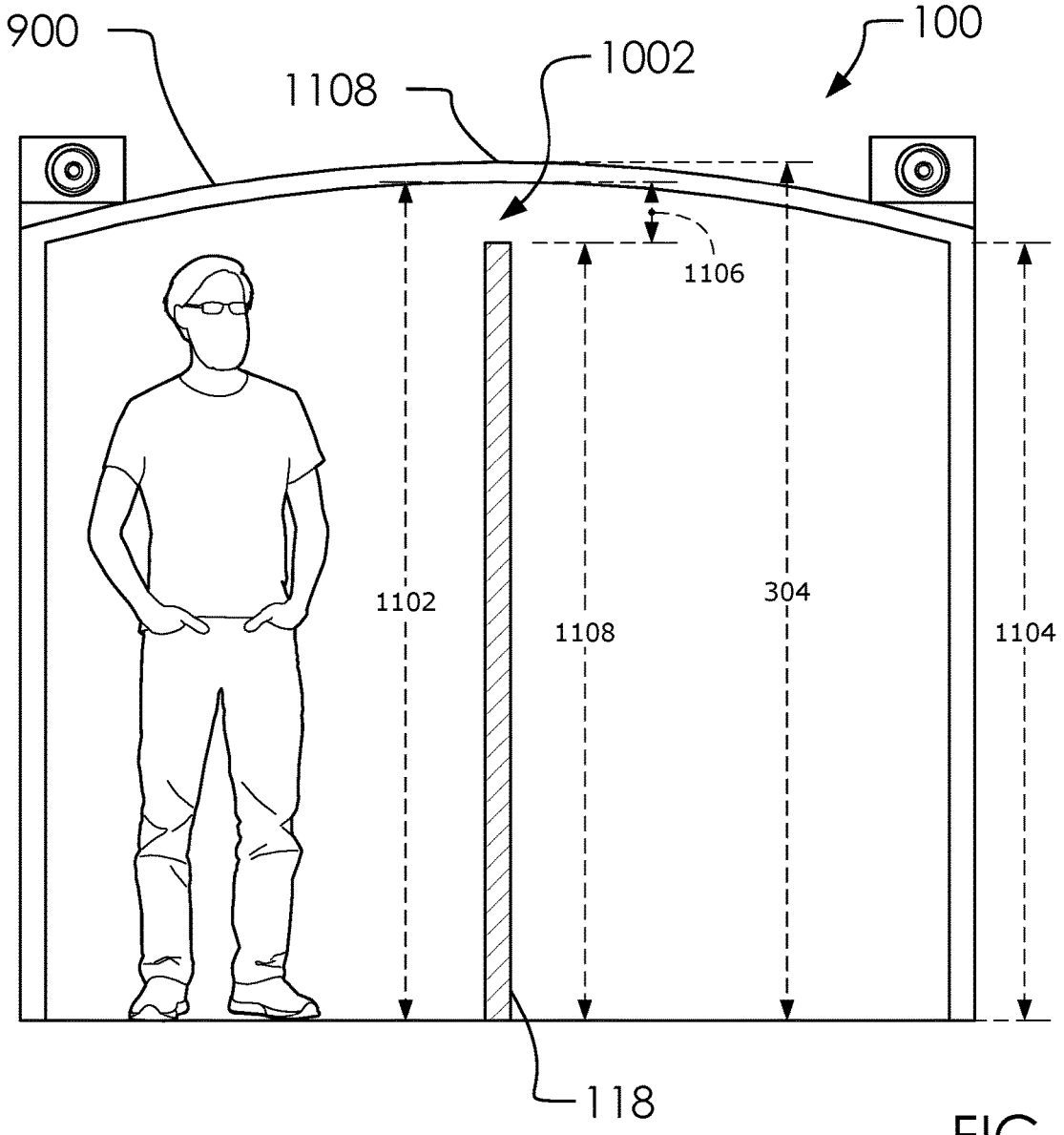
FIG. 11 illustrates an elevated side view of said acoustic isolation booth 100 with said arched roof 900.

FIG. 11 illustrates an elevated side view of said acoustic isolation booth 100 with said arched roof 900.

In one embodiment, said intermediate wall 118 can comprise said intermediate wall height 314, said acoustic isolation booth 100 can comprise said shell height 304, said two compartments 102 can comprise a first height 1102 and a second height 1104, and said sound gap 1002 can comprise a sound gap height 1106.

Since said ceiling 206 can be arched as illustrated with said arched roof 900 or flat as shown in FIG. 2, said shell height 304 can comprise either a substantially unchanging variable, or a changing variable. For example, said shell height 304 can comprise said first height 1102 in a center portion 1108 of said arched roof 900 and said second height 1104 at an edge portion proximate to said first side wall 212 and/or said second side wall 214. Wherein, said first height 1102 can be higher than said second height 1104 so as to reach a high point approximately above said intermediate wall 118 and labeled said center portion 1108.

Figure 12:
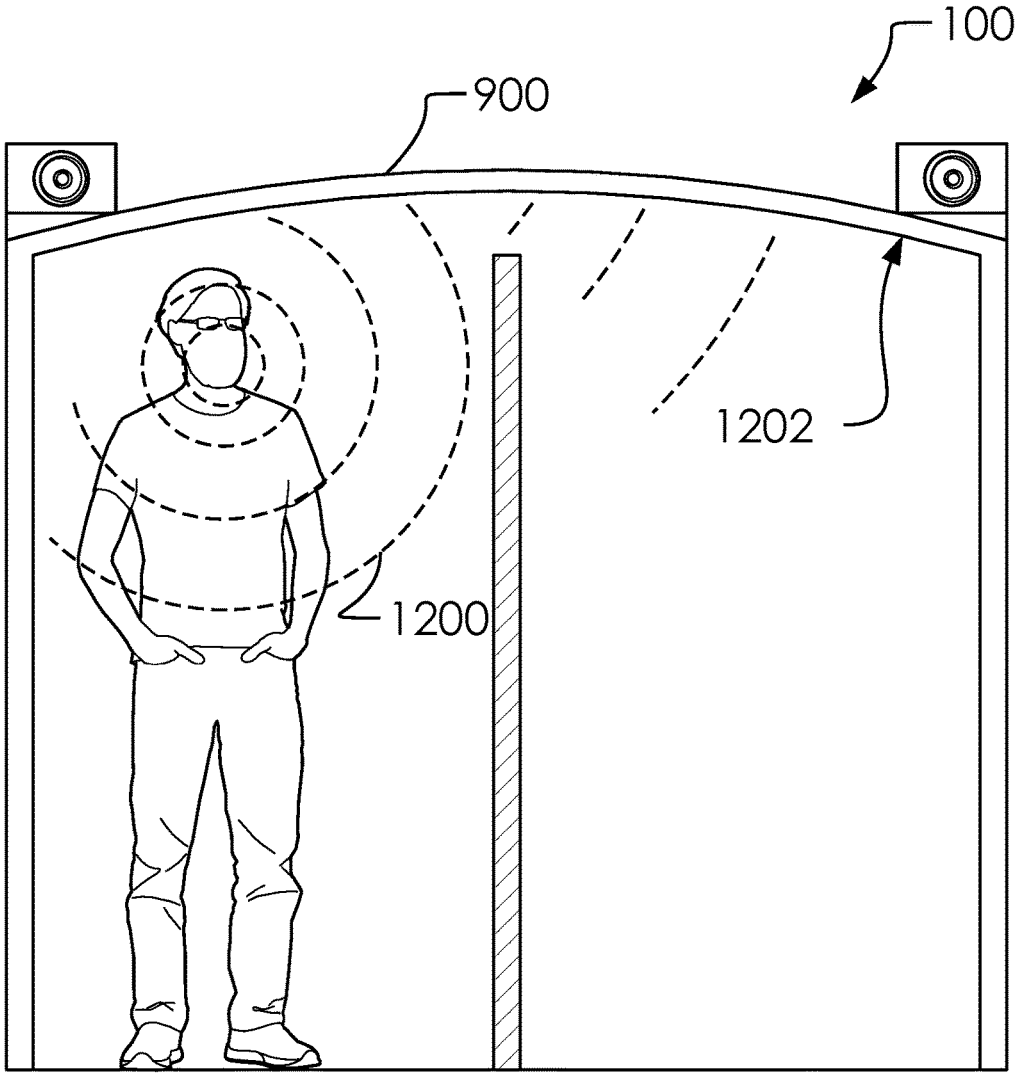
FIG. 12 illustrates an elevated side view of said acoustic isolation booth 100 with said arched roof 900.

FIG. 12 illustrates an elevated side view of said acoustic isolation booth 100 with said arched roof 900.

In one embodiment, a sound wave 1200 such as a spoken sentence or thought can originate in one among said two compartments 102 and be carried to the other. Since said sound wave 1200 cannot travel easily through said intermediate wall 118, said sound gap 1002 can allow such said sound wave 1200 too reflect off an upper internal arched surface 1202 of said ceiling 206. Since said upper internal arched surface 1202 is arched said sound wave 1200 can reflect up an against said upper internal arched surface 1202 and down into said second compartment 106.

Our own United States Capitol building displays a similar acoustical trick. In 1824, naval officer Edward Boid described how a curve (such as said arched roof 900) can dramatically amplify sound. Indeed, tour guides will often tell tales of secrets stolen by one party or the other by evesedropping in on rival politicians.

Here, however, the power of domes and/or arches is employed to the benefit and health of users. Rather than the direct transfer of germs between said first compartment 104 and said second compartment 106, germs will largely remain within their original compartment and sound can escape through said sound gap 1002, as illustrated and know in the art.

Figure 13:
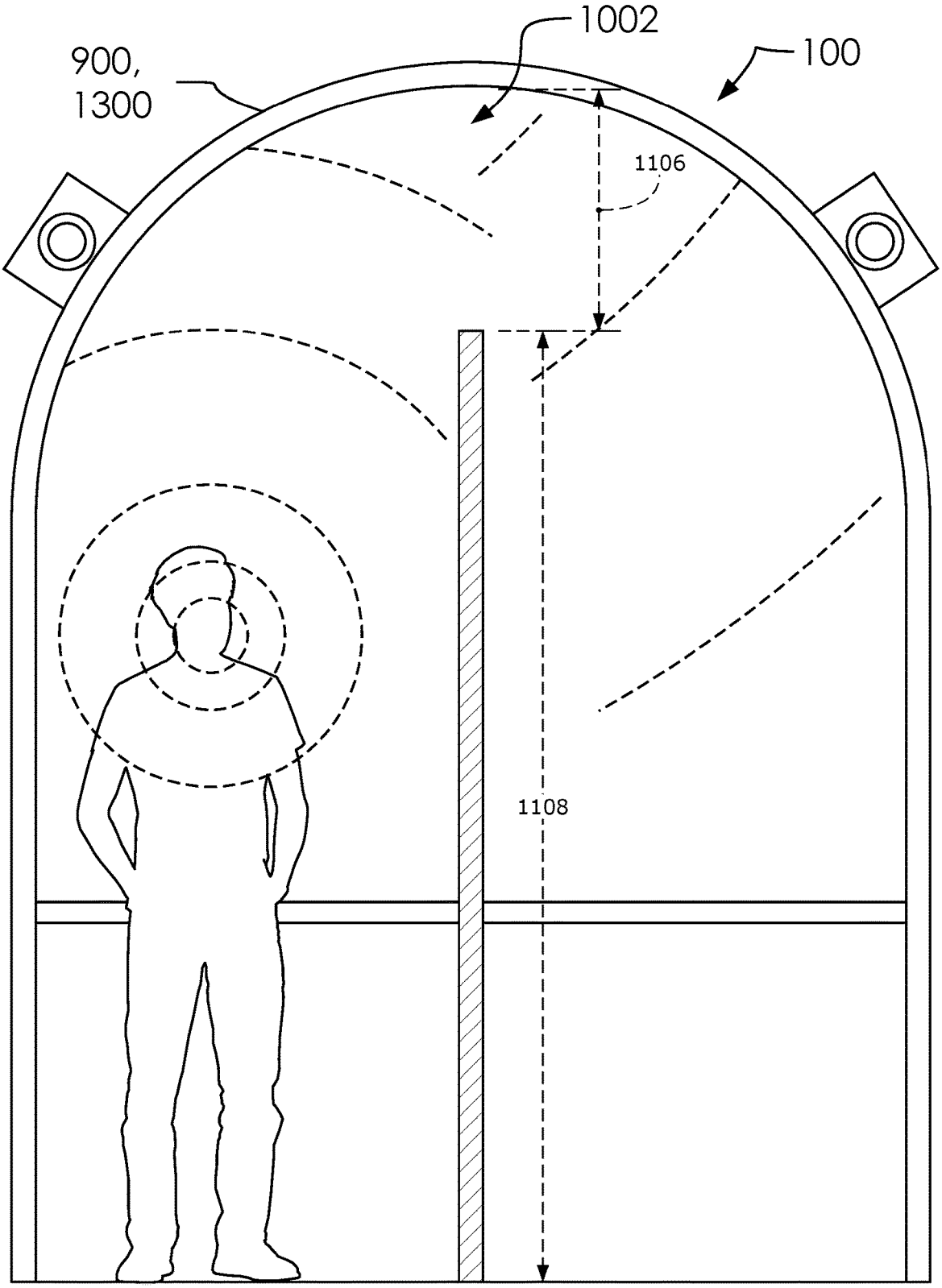
FIG. 13 illustrates an elevated side view of said acoustic isolation booth 100 with said arched roof 900 in a circular cross section embodiment 1300.

FIG. 13 illustrates an elevated side view of said acoustic isolation booth 100 with said arched roof 900 in a circular cross section embodiment 1300.

As illustrated in said circular cross section embodiment 1300, the scale of said sound gap 1002, said sound gap height 1106 and said center portion 1108 can be taken up to accommodate a full circular cross-section of said arched roof 900. In so doing, germs would be more likely to be contained as in one or the other among said two compartments 102.

The following listing of the parts is included for the convenience of the reader.

Said acoustic isolation booth 100,
Said two compartments 102,
Said first compartment 104,
Said second compartment 106,
Said one or more speakers 108,
Said intermediate wall opening 110,
Said shelf 112,
Said first shelf 114,
Said second shelf 116,
Said intermediate wall 118,
Said shell 200,
Said plurality of outer walls 202,
Said ceiling 206,
Said one or more entryways 208,
Said rear wall 210,
Said first side wall 212,
Said second side wall 214,
Said shell width 300,
Said shell depth 302,
Said shell height 304,
Said compartment depth 306,
Said compartment width 308,
Said compartment height 310,
Said thickness 312,
Said intermediate wall height 314,
Said composition 500,
Said insulation 502,
Said shell cover 504,
Said two retaining boards 506,
Said first board 508,
Said second board 510,
Said interference track 600,
Said front enclosure 702,
Said front enclosure portion 800,
Said front enclosure width 802,
Said modified opening width 804,
Said arched roof 900,
Said intermediate chamber window 1000,
Said sound gap 1002,
Said first height 1102,
Said second height 1104,
Said sound gap height 1106,
Said center portion 1108,
Said sound wave 1200,
Said upper internal arched surface 1202, and
Said circular cross section embodiment 1300.

The following sentences are written with reference to the original claims.

Said acoustic isolation booth 100 for providing a space for noisemaking out of earshot from other parties. wherein: said acoustic isolation booth 100 comprises said shell 200 comprising at least said two compartments 102, said intermediate wall 118, said plurality of outer walls 202, said ceiling 206 and said one or more entryways 208. Said shell 200 comprises said shell width 300, said shell depth 302 and said shell height 304. Said two compartments 102 comprise at least said first compartment 104 and said second compartment 106. each of said two compartments 102 comprises said compartment depth 306, said compartment width 308 and said compartment height 310. Said first side wall 212, said intermediate wall 118 and said second side wall 214 can be configured to divide a space within said shell 200 into said first compartment 104 and said second compartment 106. Said plurality of outer walls 202 and said intermediate wall 118 comprises said thickness 312. Said intermediate wall 118 comprises said intermediate wall height 314. portions of said shell 200 can be constructed of said composition 500. such as, said intermediate wall 118, said ceiling 206, said first side wall 212, said second side wall 214 and sometimes, said shelf 112. Said composition 500 comprises said insulation 502, said two retaining boards 506. Said two retaining boards 506 comprises said first board 508 and said second board 510. Said two retaining boards 506 comprises Masonite. Said insulation 502 comprises Rockwool.

Said acoustic isolation booth 100 for providing a space for noisemaking out of earshot from other parties. wherein: said acoustic isolation booth 100 comprises said shell 200 comprising at least said two compartments 102, said intermediate wall 118, said plurality of outer walls 202, said ceiling 206 and said one or more entryways 208. Said shell 200 comprises said shell width 300, said shell depth 302 and said shell height 304. Said two compartments 102 comprise at least said first compartment 104 and said second compartment 106. each of said two compartments 102 comprises said compartment depth 306, said compartment width 308 and said compartment height 310. Said first side wall 212, said intermediate wall 118 and said second side wall 214 can be configured to divide a space within said shell 200 into said first compartment 104 and said second compartment 106. Said plurality of outer walls 202 and said intermediate wall 118 comprises said thickness 312. Said intermediate wall 118 comprises said intermediate wall height 314.

Said intermediate wall 118 comprises said intermediate chamber window 1000 and said intermediate wall opening 110. Said intermediate chamber window 1000 fills said intermediate wall opening 110. Said intermediate chamber window 1000 allows a user in one among said two compartments 102 to see into the other among said two compartments 102.

Said intermediate wall 118 comprises said intermediate wall opening 110.

Each among said two compartments 102 comprises said shelf 112. Said first compartment 104 comprises said first shelf 114 and said second compartment 106 comprises said second shelf 116.

Said intermediate wall 118 comprises said intermediate chamber window 1000. Said intermediate chamber window 1000 can be configured to fill said intermediate wall opening 110 to as to prevent movement of germs between said two compartments 102.

Said acoustic isolation booth 100 comprises said ceiling 206 having said arched roof 900 and said upper internal arched surface 1202. Said intermediate wall 118 comprises said intermediate wall height 314, said acoustic isolation booth 100 comprises said shell height 304, said two compartments 102 comprises said first height 1102 and said second height 1104, and said sound gap 1002 comprises said sound gap height 1106. Said acoustic isolation booth 100 can be further comprises said sound gap 1002 between said two compartments 102 and below said ceiling 206. Said sound gap 1002 configured to allow sound otherwise blocked by said intermediate wall 118 to pass between said two compartments 102.

Said intermediate wall 118 comprises said intermediate chamber window 1000. Said intermediate chamber window 1000 can be configured to fill said intermediate wall opening 110 to as to prevent movement of germs between said two compartments 102.

Where said ceiling 206 comprise said arched roof 900, said shell height 304 comprises a changing variable between said first height 1102 and said second height 1104 at an edge portion. Said first height 1102 can be proximate to said center portion 1108 of said upper internal arched surface 1202 and said second height 1104 can be proximate to said first side wall 212 and/or said second side wall 214. Said first height 1102 can be higher than said second height 1104 so as to reach a high point approximately above said intermediate wall 118 and/or at said center portion 1108.

Said sound wave 1200 such as a spoken sentence or thought can be configured to originate in one among said two compartments 102 and be carried to the other. although said sound wave 1200 can be hindered from travelling between said two compartments 102 by said intermediate wall 118, said sound gap 1002 can be configured to allow such said sound wave 1200 too reflect off said upper internal arched surface 1202 of said ceiling 206. Said upper internal arched surface 1202 can be arched said sound wave 1200 can be configured to reflect up an against said upper internal arched surface 1202 and down into said second compartment 106.

Said sound wave 1200 such as a spoken sentence or thought can be configured to originate in one among said two compartments 102 and be carried to the other. although said sound wave 1200 can be hindered from travelling between said two compartments 102 by said intermediate wall 118, said sound gap 1002 can be configured to allow such said sound wave 1200 too reflect off said upper internal arched surface 1202 of said ceiling 206. Said upper internal arched surface 1202 can be arched said sound wave 1200 can be configured to reflect up an against said upper internal arched surface 1202 and down into said second compartment 106.

Said acoustic isolation booth 100 for providing a space for noisemaking out of earshot from other parties. wherein: said acoustic isolation booth 100 comprises said shell 200 comprising at least said two compartments 102, said intermediate wall 118, said plurality of outer walls 202, said ceiling 206 and said one or more entryways 208. Said shell 200 comprises said shell width 300, said shell depth 302 and said shell height 304. Said two compartments 102 comprise at least said first compartment 104 and said second compartment 106. each of said two compartments 102 comprises said compartment depth 306, said compartment width 308 and said compartment height 310. Said first side wall 212, said intermediate wall 118 and said second side wall 214 can be configured to divide a space within said shell 200 into said first compartment 104 and said second compartment 106. Said plurality of outer walls 202 and said intermediate wall 118 comprises said thickness 312. Said intermediate wall 118 comprises said intermediate wall height 314. Said acoustic isolation booth 100 further comprises said one or more speakers 108. Said one or more speakers 108 can be configured to play said interference track 600 comprising an audio signal emanating from said one or more speakers 108. Said interference track 600 comprises a sibilance loop of sounds such as "ch", "ss", "ttt", and similar. Said interference track 600 can be configured to interfere with parties listening in on sounds made inside of said two compartments 102. Said acoustic isolation booth 100 comprises said ceiling 206 having said arched roof 900 and said upper internal arched surface 1202. Said intermediate wall 118 comprises said intermediate wall height 314, said acoustic isolation booth 100 comprises said shell height 304, said two compartments 102 comprises said first height 1102 and said second height 1104, and said sound gap 1002 comprises said sound gap height 1106. Said acoustic isolation booth 100 can be further comprises said sound gap 1002 between said two compartments 102 and below said ceiling 206. Said sound gap 1002 configured to allow sound otherwise blocked by said intermediate wall 118 to pass between said two compartments 102.

Where said ceiling 206 comprise said arched roof 900, said shell height 304 comprises a changing variable between said first height 1102 and said second height 1104 at an edge portion. Said first height 1102 can be proximate to said center portion 1108 of said upper internal arched surface 1202 and said second height 1104 can be proximate to said first side wall 212 and/or said second side wall 214. Said first height 1102 can be higher than said second height 1104 so as to reach a high point approximately above said intermediate wall 118 and/or at said center portion 1108.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. An acoustic isolation booth for providing a space for noisemaking out of earshot from other parties; wherein:

said acoustic isolation booth comprises a shell comprising at least two compartments, an intermediate wall, a plurality of outer walls, a ceiling and one or more entryways;

said shell comprises a shell width, a shell depth and a shell height;

said two compartments comprise at least a first compartment and a second compartment;

each of said two compartments comprises a compartment depth, a compartment width and a compartment height;

a first side wall, said intermediate wall and a second side wall are configured to divide a space within said shell into said first compartment and said second compartment;

said plurality of outer walls and said intermediate wall comprises a thickness;

said intermediate wall comprises an intermediate wall height;

said acoustic isolation booth comprises said ceiling having an arched roof and an upper internal arched surface;

said intermediate wall comprises said intermediate wall height, said acoustic isolation booth comprises said shell height, said two compartments comprises a first height and a second height, and a sound gap comprises a sound gap height;

said acoustic isolation booth further comprises said sound gap between said two compartments and below said ceiling; and said sound gap configured to allow sound otherwise blocked by said intermediate wall to pass between said two compartments.

2. The acoustic isolation booth of claim 1, wherein:

said intermediate wall comprises an intermediate chamber window and an intermediate wall opening;

said intermediate chamber window fills said intermediate wall opening; and said intermediate chamber window is configured to allow a user in one among said two compartments to see into the other among said two compartments.

3. The acoustic isolation booth of claim 1, wherein:

at least one among said two compartments comprises a shelf.

4. The acoustic isolation booth of claim 1, wherein:

portions of said shell are constructed of a composition; and said composition comprises an insulation, two retaining boards, and said two retaining boards.

5. The acoustic isolation booth of claim 4, wherein:

said two retaining boards comprises Masonite; and said insulation comprises Rockwool.

6. The acoustic isolation booth of claim 1, wherein:

said acoustic isolation booth further comprises one or more speakers;

said one or more speakers is configured to play an interference track comprising an audio signal emanating from said one or more speakers;

said interference track comprises a sibilance loop of sounds such as "ch", "ss", "ttt", and similar; and said interference track is configured to interfere with parties listening in on sounds made inside of said two compartments.

7. The acoustic isolation booth of claim 6, wherein:

said interference track comprises 60 dB of sound, enough to mask noises made in said acoustic isolation booth.

8. The acoustic isolation booth of claim 1, wherein:

each of said two compartments comprises a front enclosure portion of a front enclosure encompassing a portion of said one or more entryways;

said front enclosure portion comprises a front enclosure width; and wherein, said front enclosure width plus a modified opening width is configured to equal said compartment width.

9. The acoustic isolation booth of claim 1, wherein:

said intermediate wall comprises an intermediate chamber window; and said intermediate chamber window is configured to fill said intermediate wall opening to as to prevent movement of germs between said two compartments.

10. The acoustic isolation booth of claim 1, wherein:

where said ceiling comprise said arched roof, said shell height comprises a changing variable between said first height and said second height at an edge portion;

said first height is proximate to a center portion of said upper internal arched surface and said second height is proximate to said first side wall and/or said second side wall; and said first height is higher than said second height to reach a high point approximately above said intermediate wall and/or at said center portion.

11. The acoustic isolation booth of claim 10, wherein:

said acoustic isolation booth is configured to channel a sound wave, such as a spoken sentence, from one among said two compartments and be carried to the other;

although said sound wave is hindered from travelling between said two compartments by said intermediate wall, said sound gap is configured to allow such said sound wave too reflect off said upper internal arched surface of said ceiling; and said upper internal arched surface is arched said sound wave is configured to reflect up an against said upper internal arched surface and down into said second compartment.

12. The acoustic isolation booth of claim 1, wherein:

said acoustic isolation booth is configured to channel said sound wave, such as a spoken sentence, from one among said two compartments and be carried to the other;

although said sound wave is hindered from travelling between said two compartments by said intermediate wall, said sound gap is configured to allow such said sound wave to reflect off said upper internal arched surface of said ceiling; and said upper internal arched surface is arched said sound wave is configured to reflect up an against said upper internal arched surface and down into said second compartment.

* * * * *